US005167537A

United States Patent [19]

Johnescu et al.

[11] Patent Number: 5,167,537

[45] Date of Patent: Dec. 1, 1992

[54] HIGH DENSITY MLV CONTACT ASSEMBLY

[75] Inventors: Douglas M. Johnescu, Gilbertsville; Joseph D. Magnan, South Kortright, both of N.Y.

[73] Assignee: Amphenol Corporation, Wallingford, Conn.

[21] Appl. No.: 698,131

[22] Filed: May 10, 1991

[51] Int. Cl.[5] ..... H01R 13/66

[52] U.S. Cl. ..... 439/620; 333/185

[58] Field of Search ..... 439/608, 620; 333/181-185

[56] References Cited

U.S. PATENT DOCUMENTS

| | | | |
|---|---|---|---|
| 3,740,701 | 6/1973 | Harnden, Jr. | 338/220 |
| 4,328,523 | 5/1982 | Seguin | 361/56 |
| 4,572,600 | 2/1986 | Nieman | 339/14 |
| 4,582,385 | 5/1986 | Cooper et al. | 339/147 |
| 4,600,262 | 7/1986 | Nieman et al. | 339/147 |
| 4,646,037 | 2/1987 | Turolla et al. | 333/182 |
| 4,647,138 | 3/1987 | Muz | 439/620 |
| 4,707,048 | 11/1987 | Gliha et al. | 333/185 |
| 4,707,049 | 11/1987 | Gliha | 439/620 |
| 4,741,710 | 5/1988 | Hogan et al. | 439/620 |
| 4,746,310 | 5/1988 | Morse et al. | 439/620 |
| 4,747,789 | 5/1988 | Gliha | 439/620 |
| 4,768,977 | 9/1988 | Gliha, Jr. et al. | 439/620 |
| 4,794,485 | 12/1988 | Bennett | 361/127 |
| 4,804,338 | 2/1989 | Dibble et al. | 439/932 |
| 4,809,124 | 2/1989 | Kresge | 361/58 |
| 4,846,732 | 7/1989 | Meelhuysen | 439/620 |
| 4,907,119 | 3/1990 | Allina | 361/56 |
| 4,959,262 | 9/1990 | Charles et al. | 338/20 |
| 5,008,646 | 4/1991 | Hennings et al. | 338/20 |
| 5,046,968 | 9/1991 | Baur et al. | 333/183 |

FOREIGN PATENT DOCUMENTS

| | | | |
|---|---|---|---|
| 8803717 | 5/1988 | PCT Int'l Appl. | 439/620 |
| WO88/03717 | 5/1988 | World Int. Prop. O. . | |

OTHER PUBLICATIONS

Clarence Shivers, "An SMD Varistor Produced Using Multilayer Techniques," [Electronic Engineering, Feb. 1990, No. 758.

*Primary Examiner*—Gary F. Paumen

*Attorney, Agent, or Firm*—Bacon & Thomas

[57] ABSTRACT

A transient suppression contact assembly, capable of low working voltages and high energy handling capacity, including lightning suppression, employs a multilayered varistor as the transient suppression device. The varistor is mounted in a notch in the contact and connected to ground via a ground sleeve. An insulator sleeve separates the ground sleeve from the contact, and both the insulator sleeve and ground sleeve include a gap or groove extending the length of the sleeve to permit the sleeves to be snapped onto the contact and aligned without the need for additional adhesive staking operations.

18 Claims, 6 Drawing Sheets

HIGH DENSITY MLV CONTACT ASSEMBLY

BACKGROUND OF THE INVENTION

1. Field of the Invention

This invention relates to electrical connectors, and in particular to an electrical connector having transient suppression capabilities.

2. Description of Related Art

As circuit densities of electronic devices increase, the sensitivity of the individual circuit elements in the devices to transient voltages also increases, making ever more critical the need for transient voltage suppression (TVS) of all signal and data inputs. This is often most conveniently accomplished by placing transient suppression filters within the miniature electrical connectors used to connect signal and data lines with the electrical devices.

Examples of transient suppression elements which have been successfully placed in connectors include metal oxide varistors (MOV's) and zener diodes. Zener diodes are useful because they provide a low working voltage for the signal and data lines to the electrical devices, and because of their ability to limit voltage spikes of especially short duration and sharp waveform. However, zener diodes in sizes small enough to package inside a connector lack the powder handling capacity of the otherwise less efficient metal oxide varistors. Therefore, zener diodes have conventionally been used to protect signal and data lines from relatively low energy electrostatic discharges, while metal oxide varistor devices have been required where protection from secondary lightening transients is necessary, such as in aircraft.

Despite the utility of conventional transient suppression connectors, it has heretofore been impossible to achieve a transient suppression device for use in a connector which provides both the low working voltage and transient suppression capability of a zener diode, and the substantially increased energy handling capacity of a metal oxide varistor.

Furthermore, the assembly of high density transient suppression contact assemblies for use in miniature connectors has heretofore been a relatively difficult procedure because of the small size of typical high density contact arrangements, and the numerous staking and alignment operations required to position and secure the various components without making the connector too large for the application.

SUMMARY OF THE INVENTION

In view of the above-described disadvantages of conventional TVS connectors, it is therefore an objective of the invention to provide a low voltage TVS connector having increased energy handling capacity and yet which eliminates the need for increased connector size and for complex staking and alignment operations during manufacture.

It is a further objective of the invention to provide a transient suppression filter connector for low voltage data or signal lines capable of meeting requirements for lightning suppression.

It is a still further objective of the invention to provide a transient suppression filter connector which provides the low working voltage of a zener diode (approximately 5.6–60 volts) with a substantial increase in energy handling capacity (on the order of 1 joule versus 0.35 joules for a zener diode).

It is a still further objective of the invention to provide a filter connector in which the filter grounding and insulation elements are self-aligning.

Finally, it is yet another objective of the invention to provide a transient suppression contact assembly in which a feedthrough contact is inserted within a transient suppression device grounding sleeve and insulator by simply "snapping" the insulator onto the contact.

These objectives are achieved by providing a transient suppression connector which uses a multi-layered (MLV) to hold the signal or data line contacts to a specific voltage.

The objectives are further achieved by using a unique contact construction, including a recess for mounting the MLV, and a cylindrical ground contact which includes a resilient tine for biasing the MLV against a wall of the recess, thus enabling the MLV to fit within the cylindrical constraints of a double-density contact arrangement.

In addition, the objectives of the invention are achieved by providing a transient suppression device grounding sleeve and insulator which are longitudinally slotted, allowing the insulator and grounding sleeve to be snapped radially into place on a feedthrough contact instead of being axially slid over a smaller diameter contact portion and epoxy staked or secured by a similar more labor-intensive method.

BRIEF DESCRIPTION OF THE DRAWINGS

FIG. 2(*b*) is a cross-sectional end view of a connector contact taken along line A—A of FIG. 2(*a*).

FIG. 3(*b*) is an elevated end view of the contact ground sleeve of FIG. 3(*a*).

FIG. 4(*b*) is an elevated end view of the insulator sleeve of FIG. 4(*a*).

FIG. 9(*b*) is a cross-sectional end view of a connector contact taken along line B—B of FIG. 8.

FIG. 10(*b*) is a an elevated end view of the contact ground sleeve of FIG. 10(*a*).

FIG. 11(*b*) is a cross-sectional side view of the insulator sleeve of FIG. 11(*a*).

FIG. 11(*c*) is an elevated end view of the insulator sleeve of FIG. 11(*a*).

FIG. 11(*d*) is an elevated end view taken from an opposite end of the insulator sleeve in respect to the view shown in FIG. 11(*c*).

DETAILED DESCRIPTION OF THE PREFERRED EMBODIMENTS

Figure 1:
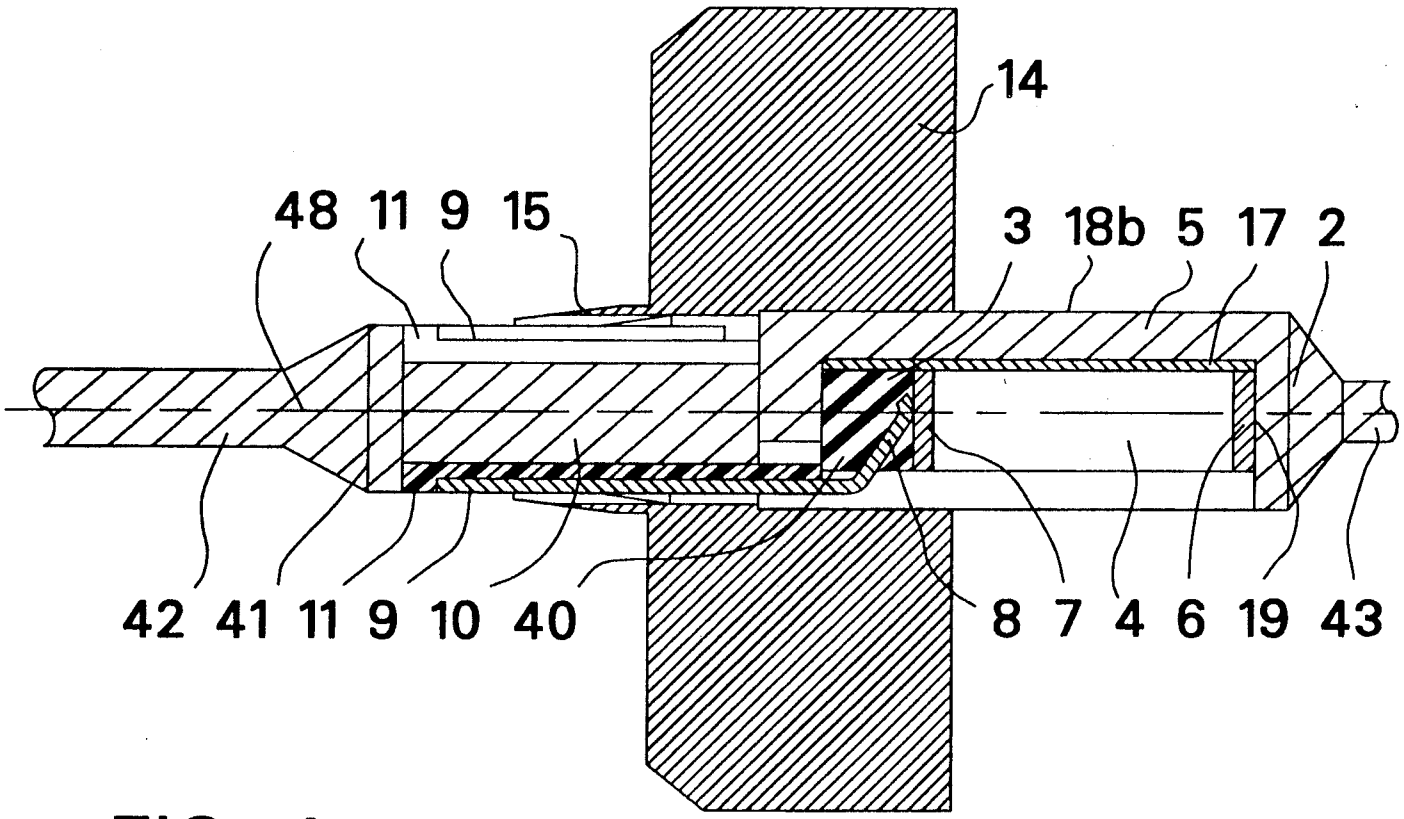
FIG. 1 is a cross-sectional side view of a transient suppression connector contact assembly according to a preferred embodiment of the invention.

FIG. 1 shows a transient suppression contact assembly 1 including a feedthrough pin-to-pin contact 2 having an approximately centrally located recess or notch 3. A transient suppression MLV chip is seated within recess 3 on a mounting part 5 of contact 2. It will be appreciated from the following discussion that due to the unique design of the ground and insulator sleeves, pin-to-pin contact 2 may easily be replaced by a pin-socket contact or by a socket-socket contact as desired.

MLV chip 4 includes a live or hot electrode 6 which contacts wall 19 of recess 3, a ground electrode 7 which contacts a flexible tine 8 on contact ground sleeve 9, and interleaved layers of electrodes within the varistor material which alternately extend from either the live or ground electrodes, as will be explained in more detail below. Contact ground sleeve 9 is located on ground sleeve mounting part 10. Flexible tine 8 biases MLV chip 4 against wall 19 to ensure engagement between wall 19 and hot electrode 6 during assembly. Between contact ground sleeve 9 and ground sleeve mounting part 10 of contact 2 is an insulator sleeve 11 which electrically isolates contact ground sleeve 9 from contact 2.

It will be appreciated that contact assembly 1 may be fitted into a variety of known connector configurations. The particular connector shown is a cylindrical double-density connector of the type disclosed in U.S. Pat. Nos. 4,707,048 and 4,707,049, both assigned to Amphenol Corporation. This type of connector includes a ground plane 14 having flexible tines 15 which extend into a plurality of apertures to engage and secure a good electrical contact between the ground plane and the transient suppression devices on each contact pin. Ground plane 14 is electrically connected to a grounded metallic connector shell (not shown). Because of the shape of the apertures defined by tines 15 in the illustrated connector, the contact ground sleeve 9 should be generally cylindrical and of a suitable diameter to fit within the apertures defined by ground plane tines 15. However, if other connector and ground plane configurations are used, the shape of the ground sleeve and other components may of course be varied accordingly.

MLV chip 4 is a ceramic varistor which provides the low working voltage of a zener diode (approximately 5.6–60 volts) with a substantial increase in energy handling capacity (typically 1 joule, or 48,000 watts for a 8×20 ms pulse, vs. 0.35 joules) by using internal electrode layering instead of larger grain sizes to control the number of grain boundaries between electrodes, the interleaving of the electrodes increasing the energy handling capabilities of the device by providing additional surface areas for energy dissipation, while the standard grain size provides uniform breakdown and energy dissipation throughout the matrix instead of at select grain boundaries. This is important because it provides a stable TVS in case of repetitive pulses at maximum power rating. For the exemplary double density connector, the thickness of the MLV chip should be accommodated within a contact pin having a maximum diameter of approximately 0.090". To fit within this package, the relationship of the height to the width of the MLV may of course be varied as necessary within a permissible range. An illustrative set of dimensions is approximately 0.15" long×0.050" wide by 0.050" thick.

Figure 2A:
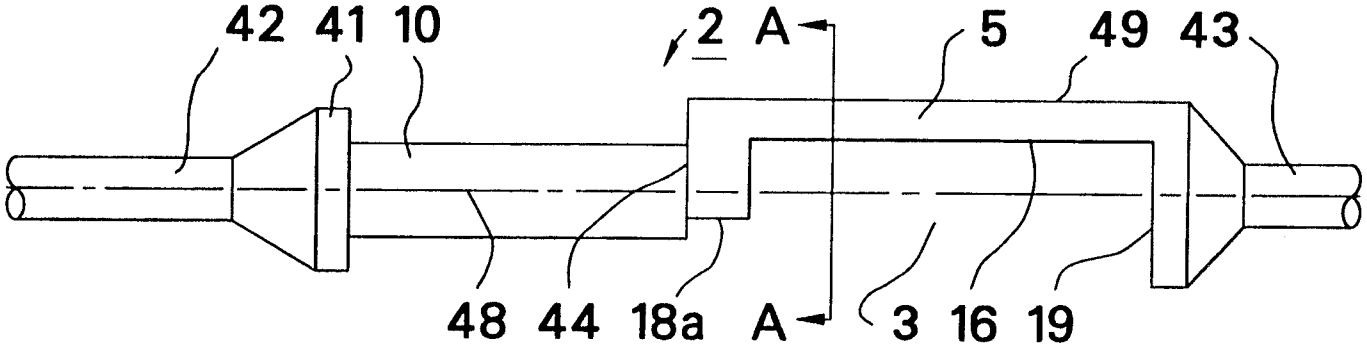
FIG. 2(*a*) is an elevated side view of a connector contact according to the preferred embodiment shown in FIG. 1.
Figure 2B:
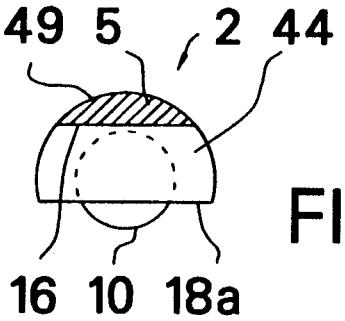

As shown in FIG. 2, contact 2 includes mounting part 5, insulator sleeve mounting part 10, and pin portions 42 and 43 for mating with corresponding sockets in an external device or connector. Mounting part 10 is essentially cylindrical and has a cylindrical axis which is coaxial with a principal axis 48 of the contact pin, while mounting part 5 is positioned eccentrically in respect to the principal axis 48. Mounting part 5 has a curved exterior surface 49 and a flat surface 16 which defines the bottom of recess 3 and to which MLV 4 is attached. An orientation flat 18*a* is located on the cylinder which connects mounting part 5 to mounting part 10 in the preferred embodiment.

MLV 4 is mounted to mounting part 5 such that live electrode 6 is electrically connected to wall 19 of recess 3 while ground electrode 7 contacts flexible tine 8 of ground sleeve 9. In order for the MLV 4 to operate, ground electrode 7 must be insulated from surface 16. This is preferably accomplished by placing an insulating tape 17 between MLV 4 and surface 16. Solder or a conductive adhesive material (not shown) is preferably also added to the respective live and/or ground electrode connections to ensure a good electrical contact and help secure the MLV in recess 3. In addition, the MLV mounting portion 5 of assembly 1 is preferably surrounded by heat shrink tubing 18*b* to provide insulation between adjacent contacts and between the contacts and ground. An encapsulate 40 is included within the tubing, surrounding the MLV, for added strength and protection from mechanical and thermal shocks.

Figure 3A:
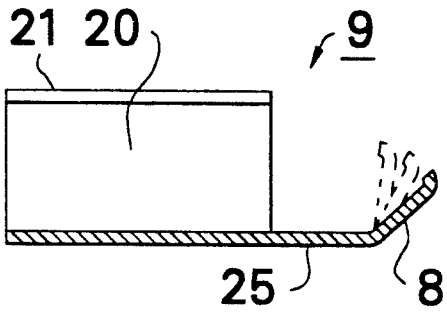
FIG. 3(*a*) is a cross-sectional side view of a contact ground sleeve according to the preferred embodiment shown in FIG. 1.
Figure 3B:
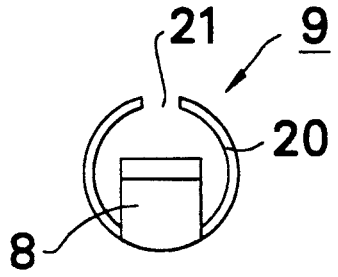
Figure 4A:
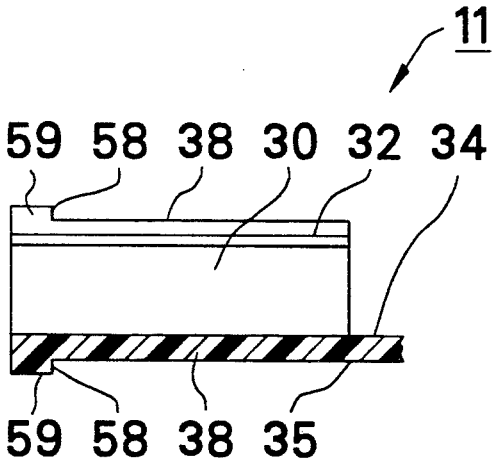
FIG. 4(*a*) is a cross-sectional side view of an insulator sleeve according to the preferred embodiment shown in FIG. 1.
Figure 4B:
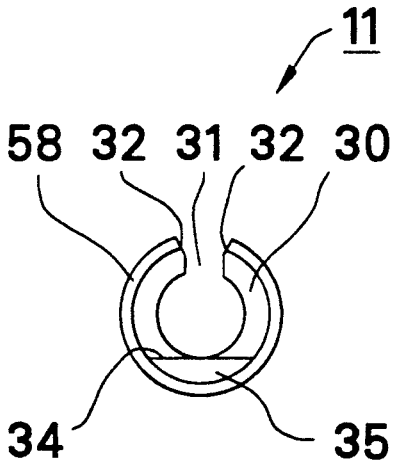

FIGS. 3(*a*), 3(*b*), 4(*a*), and 4(*b*) show a contact ground sleeve 9 and insulator sleeve 11 having a unique groove and self-alignment arrangement which permits the sleeves to be assembled to the contact pin 2 simply by snapping contact 2 into the sleeves in a radial direction, respective to axis 48, of the sleeves. This feature permits the use of socket-to-socket type contacts as well as pin-to-pin or pin-to-socket contacts. Socket-to-socket contacts had previously been difficult to use in this type of arrangement because they have end diameters which are generally too large to slide a sleeve over unless the sleeve is constructed in the manner of the invention. Use of self-aligning snap-fit ground and insulator sleeves 9 and 11 also eliminates the need for staking, using adhesives or epoxy, to secure the sleeves in place on sleeve mounting portion 10.

As shown in FIGS. 3(*a*) and 3(*b*), contact ground sleeve 9 is formed of a single piece of resilient electrically conductive metal and has a cylindrical main body 20 including a gap or groove 21 which extends the length of the main body. Axially extending from a side of main body 20 which is diametrically opposite groove 21 is a flat projection 25 ending in flexible tine 8. As noted above, flexible tine 8 serves to bias MLV 4 against wall 19, and to electrically connect ground electrode 7 to ground via sleeve 9, ground plane tines 15, and ground plane 14.

Ground sleeve 9 fits over ground sleeve mounting portion 38 of insulation sleeve 11, which itself fits over insulator sleeve mounting portion 10 of contact 2. The ground sleeve is held axially in place on mounting portion 38 by shoulder 58 of annular extension 59. Orientation flat 18*a* serves to circumferentially orient insulator sleeve 11 by cooperating with extension 35 while sleeve 11 is axially located by wall 44 on orientation flat 18*a* and annular shoulder 41 on contact 2. Extension 35 extends axially from cylindrical main body 30 of sleeve 11 and includes a flat surface 34 which faces orientation flat 18*a* when the sleeves and contact are properly aligned, and extension 25 of ground sleeve 9 when ground sleeve 9 and insulator sleeve 11 are aligned.

On the side of main body 30 of insulator sleeve 11 which is diametrically opposite extension 35 is a gap or groove 31 extending the length of the main body. Groove 31 aligns with groove 21 of ground sleeve 9 when the sleeves are properly positioned, but has an inside width which is narrower than the width of groove 21, groove 31 possessing bevelled edges 32 to facilitate "snapping" of the contact 2 into the sleeve (or, conversely, the sleeve onto the contact) as follows: During assembly, as contact 2 is pushed first through groove 21 and then through groove 31, beveled edges 32 engage contact 2 causing insulator sleeve 11 and ground sleeve 9 to flex radially outwardly, i.e., tangentially in respect to said groove, against a resilient restoring force until the contact has passed through groove 31, at which time sleeves 9 and 11 return to their original shapes, retaining or locking contact 2 within the sleeves.

In order to assemble the transient suppression contact assembly of the invention, therefore, it is simply necessary to fit ground sleeve 9 over insulating sleeve 11 which are thereby mutually aligned due to the cooperation between extensions 25 and 35. Sleeve mounting portion 10 is then pushed through grooves 21 and 31 to "snap" the sleeves onto the contact, and MLV chip 4 is mounted within recess 3 using insulating tape, solder, and/or conductive adhesive as described above. Finally, the MLV chip is encapsulated within the heat shrink tube 18*b* complete the assembly.

It will of course be appreciated by those skilled in the art that the dimensions and shapes of all assemblies described herein may be varied as dictated by the dimensions of the connector and contact pin mating sections with which the contact assembly is to be used. For example, for a size 22 contact pin assembly whose mating sections have a diameter of 0.0300" and whose total length is 1.157", mounting part 5 and recess 3 preferably have a length of 0.172" and a thickness of 0.016", which is sufficient to allow for standard feedthrough contact current ratings. The diameter of the surface 49 in this example is 0.080" and the diameter of contact ground sleeve mounting part 10 is 0.042". For purposes of this example, contact ground sleeve 9 has an outer diameter of 0.071" and a length of 0.122" with extension 25 ending in flexible tine 8 for a length of about 0.050". Flexible tine 8 has a width of 0.035" and insulator sleeve 11 has an outer diameter of 0.072" and a main body length of 0.142". Finally, the widths of grooves 21 and 31 are 0.020" and 0.015" respectively. It will be noted by those skilled in the art that the maximum diameter of the assembly is well under 0.09", resulting in an exceptionally compact arrangement in view of its lightning suppression capabilities.

Figure 7:
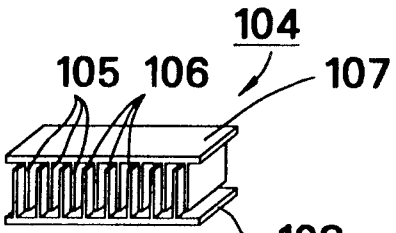
FIG. 7 is a perspective view showing the internal electrode arrangement of an MLV device suitable for use with the embodiment shown in FIG. 5.
Figure 9B:
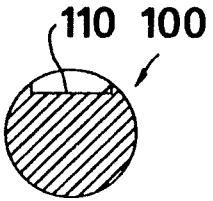
FIG. 9(*a*) is a cross-sectional end view of a connector contact taken along line C—C of FIG. 8.
Figure 9A:
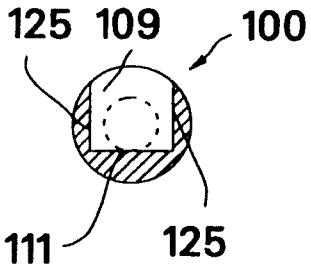

The preferred embodiment of the invention shown in FIGS. 6–11 also uses self-aligning, snap-fit ground and insulator sleeves to eliminate the need for staking, adhesives, or epoxy, when securing the sleeves in place on a sleeve mounting portion of the contact. This embodiment also is especially suitable for use with an MLV chip although, as shown in FIG. 7, the MLV chip of the second preferred embodiment uses vertical rather than horizontal internal electrode layering. Because respective ground and live electrodes 105 and 106 extend vertically in respect to external electrodes 107 and 108, it is possible to simplify the manner in which the MLV chip is electrically connected to the contact and to ground sleeve 102.

Figure 5:
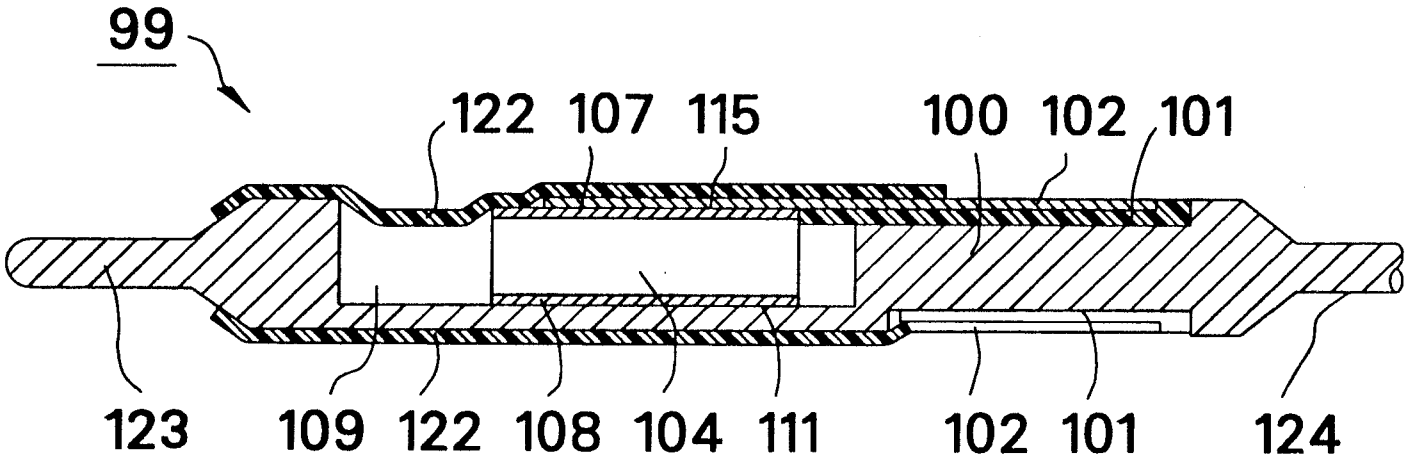
FIG. 5 is a cross-sectional side view of a transient suppression connector contact assembly according to a second preferred embodiment of the invention.

It will of course be appreciated that contact assembly 99 (FIG. 5) of the second preferred embodiment may be fitted into the same variety of known connector configurations as may contact assembly 1 of the first preferred embodiment, and that contact assembly 99 may be substituted for contact assembly 1, as shown in FIG. 1, without modification of ground sleeve 14 or tines 15.

Figure 6:
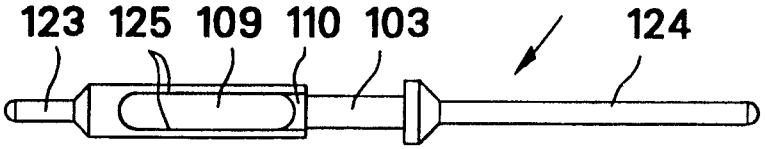
FIG. 6 is an elevated top view of a connector contact according to the preferred embodiment shown in FIG. 5.
Figure 8:
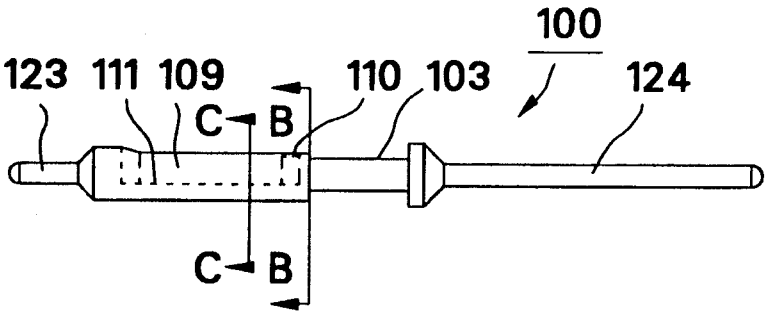
FIG. 8 is an elevated side view of the connector contact of FIG. 6.

As shown in FIGS. 6 and 8, contact 100 include insulation sleeve mounting portion 103 and a notch 109, shown in dashed line in FIG. 8. A similar notch may also be used in connection with the corresponding contact 2 of the first preferred embodiment. Contact 100 also includes mating pin sections 123 and 124, and an alignment flat 110, best shown in FIG. 9*b*, which corresponds to alignment flat 18*a* of the first preferred embodiment.

MLV chip 104 is seated within notch 109 such that lower electrode 108 electrically contacts flat mounting surface 111 at the base of the notch. Alignment of the MLV chip along the longitudinal axis of the contact is not critical. Lateral alignment of the chip is provided by sides 125 of notch 109.

Figure 10A:
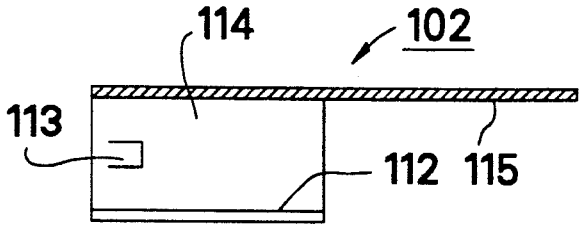
FIG. 10(*a*) is a cross-sectional side view of a contact ground sleeve according to the preferred embodiment shown in FIG. 5.
Figure 10B:
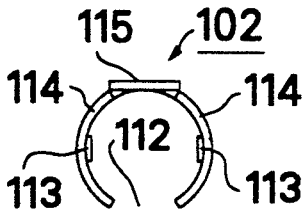
Figure 11A:
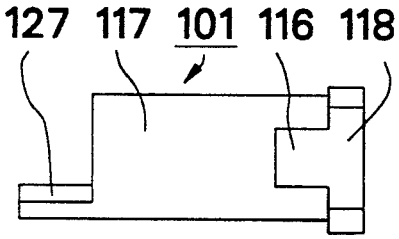
FIG. 11(*a*) is a elevated side view of an insulator sleeve according to the preferred embodiment shown in FIG. 5.
Figure 11C:
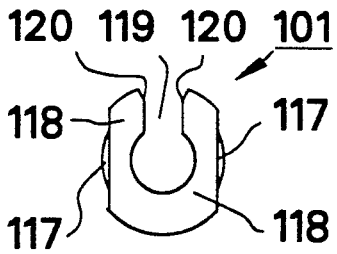
Figure 11B:
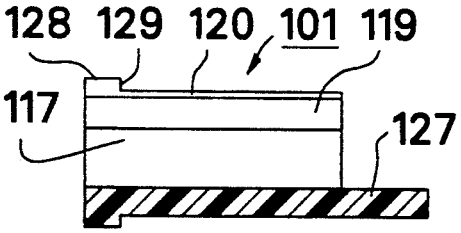
Figure 11D:
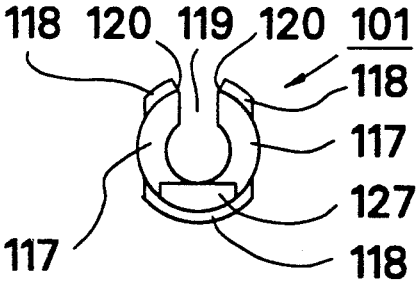

Conductive ground sleeve 102, best shown in FIG. 10, is similar to ground sleeve 17 of the first preferred embodiment in that it includes a groove 112 which enables "snapping" of ground sleeve 102 onto mounting portion 103. However, ground sleeve 102 differs from ground sleeve 17 in that cylindrical portion 114 includes alignment tabs 113 arranged to fit within notches 116 provided in insulation sleeve 101. In addition, it is not necessary to provide a resilient MLV chip biasing extension corresponding to flexible tine 8 because of the top facing location of ground electrode 107 on MLV chip 104. Instead, ground sleeve 102 includes a flat extension 115 which contacts electrode 107 to form the ground connection between cylindrical main body portion 114 and the MLV chip.

As in the first preferred embodiment, ground sleeve 102 fits over an insulating sleeve 101. Insulating sleeve 101 includes generally cylindrical main body portion 117, and an alignment portion 118 including notches 116 which engage alignment tabs 113 on the ground sleeve to align the ground and insulation sleeves prior to assembly of the sleeves to the contact. Insulation sleeve 101 also includes a groove 119 having beveled sections 120 which permits the insulation sleeve to be "snapped" over mounting portion 103 in the same manner as insulation sleeve 11 of the first preferred embodiment is snapped onto contact 2.

An extension 127 is provided on insulation sleeve 101 for cooperation with alignment flat 110 in the same manner as extension 35 of insulation sleeve 11 cooperates with alignment flat 18*a* in the first preferred embodiment. The alignment sleeve 101 of the second preferred embodiment further includes an annular shoulder 128 which defines an alignment surface 129, further ensuring proper longitudinal alignment of ground sleeve 102 in respect to insulation sleeve 101.

Finally, a heat shrink tube 122 may be applied over the MLV chip and ground sleeve secure the package in the same manner as does tubing 18*b* of the first preferred embodiment.

Those skilled in the art will note that the second preferred embodiment of the invention possesses the advantages that insulation tape is not needed on the contact flat, that the shorter plates in the MLV cause less inductance, and that the exterior electrodes 7 and 8 of the MLV chip are larger, simplifying placement and attachment. In addition, more plate area is provided in the MLV, increasing energy handling capability. Although the dimensions of the MLV chip may of course be varied within the scope of the invention, an exemplary MLV chip for a size 22 contact has a maximum thickness of approximately 0.047", and a maximum width of about 0.060". The length of the exemplary chip depends on the desired electrical characteristics of the MLV chip.

It will of course be appreciated by those skilled in the art that the unique snap mounting sleeve arrangement of both embodiments of the invention may be used with diodes and other filter elements in addition to or in place of MLV devices, while the use of an MLV in a TVS connector is not limited to the specific mounting arrangement described above. Accordingly, because of the numerous variations which are possible within the scope of the invention, it is intended that the scope of the invention not be limited by the above description, but rather that it be limited solely by the appended claims.

We claim:

1. A transient suppression contact assembly for use in an electrical connector comprising:

feedthrough contact means for carrying electrical signals from one electrical device to a second electrical device;

a multi-layered varistor having a live electrode and a ground electrode, said varistor being mounted on said contact means;

means including a generally cylindrical grounding sleeve substantially surrounding a portion of said contact means for electrically connecting said ground electrode to ground; and means for electrically connecting said live electrode to said contact means, wherein said contact means further comprises a recess in which said varistor is mounted, and wherein said ground sleeve further comprises means including a resilient tine for biasing said varistor against a wall of said recess in a direction parallel to a principal axis of said contact.

2. An assembly as claimed in claim 1, wherein said contact means comprises means including a flat mounting surface for mounting said varistor on said contact means.

3. An assembly as claimed in claim 3, wherein said mounting surface forms the bottom of a recess in said contact means.

4. An assembly as claimed in claim 1, wherein said contact means comprises a recess in which said varistor is mounted.

5. An assembly as claimed in claim 1, wherein said ground sleeve comprises means defining a groove extending a length of said ground sleeve, and further comprising a cylindrical insulator sleeve positioned between said ground sleeve and said contact means, said insulator sleeve also comprising means defining a second groove which extends a length of said insulator sleeve.

6. An assembly as claimed in claim 5, wherein said means defining a second groove includes means comprising bevelled edges of said second groove for causing said second groove to expand tangentially as said contact means is pushed through said second groove during assembly of said insulator sleeve and contact means and, after said contact means has been pushed through the second groove and positioned within said insulator sleeve, to be restored to a size which it originally possessed before expansion in response to engagement by said contact means.

7. An assembly as claimed in claim 5, wherein said contact means further comprises an alignment flat for axially and circumferentially positioning said sleeves in respect to said contact means.

8. An assembly as claimed in claim 1, wherein said ground electrode is electrically isolated from said contact means by means of an insulating length of tape.

9. An assembly as claimed in claim 1, further comprising means including an encapsulant and a surrounding heat shrink tube for isolating said varistor from other contact means in said connector and for protecting said varistor from mechanical and thermal shocks.

10. An assembly as claimed in claim 1, wherein a largest diameter of said assembly is less than 0.09".

11. An assembly as claimed in claim 1, wherein said varistor comprises interleaved electrodes alternately connected to said live and ground electrodes.

12. An assembly as claimed in claim 1, wherein a working voltage of said contact assembly is less than 60 volts.

13. An assembly as claimed in claim 12, wherein an energy handling capacity of said contact assembly is approximately 1 joule.

14. An assembly as claimed in claim 1, wherein said transient suppression includes lightning suppression.

15. A transient suppression contact assembly for use in an electrical connector comprising:

feedthrough contact means for carrying electrical signals from one electrical device to a second electrical device, said contact means including a transient suppression device mounting surface and an insulator/ground sleeve mounting portion;

a transient suppression device having two electrodes mounted on said device mounting surface such that one of said electrodes is electrically connected to said contact means and the second is electrically insulated therefrom;

a conductive ground sleeve electrically connected to said second electrode and substantially surrounding said contact means;

means including an insulator sleeve positioned between said ground sleeve and said mounting portion of said contact means for electrically isolating said ground sleeve from said contact means; and means comprising grooves in said ground sleeve and insulating sleeve for permitting said contact means to be snapped into said ground and insulator sleeves in a radial direction of each of said sleeves.

16. An assembly as claimed in claim 15, wherein a width of said groove in said insulator sleeve is greater than or equal to the width of said groove in said ground sleeve.

17. An assembly as claimed in claim 16, wherein said groove in said insulator sleeve comprises means including beveled edges for permitting said contact means to be snapped into said insulator sleeve by causing said contact means to exert a tangential force on said insulator sleeve when said contact means is pushed into said insulator sleeve to cause said insulator sleeve groove to expand tangentially until said contact means has passed through said insulator sleeve groove, whereupon a restoring force of said insulator sleeve causes it to retract and lock said contact means within said insulator sleeve, said ground sleeve groove expanding and retracting together with said insulator sleeve groove.

18. An assembly as claimed in claim 15, wherein said groove in said insulator sleeve comprises means including beveled edges for permitting said contact means to be snapped into said insulator sleeve by causing said contact means to exert a tangential force on said insulator sleeve when said contact means is pushed into said insulator sleeve to cause said insulator sleeve groove to expand tangentially until said contact means has passed through said insulator sleeve groove, whereupon a restoring force of said insulator sleeve causes it to retract and lock said contact means within said insulator sleeve.

* * * * *